United States Patent [19]

Von Muller

[11] Patent Number: 4,461,108

[45] Date of Patent: Jul. 24, 1984

[54] REVOLVER SAFETY LOCK

[76] Inventor: Francis Von Muller, 153 State St., Brooklyn, N.Y. 11201

[21] Appl. No.: 334,138

[22] Filed: Dec. 24, 1981

[51] Int. Cl.[3] ..... F41C 17/08; F41C 27/00

[52] U.S. Cl. ..... 42/1 LP

[58] Field of Search ..... 42/1 LP, 1 Y

[56] References Cited

U.S. PATENT DOCUMENTS

| | | | |
|---|---|---|---|
| 3,085,360 | 4/1963 | Robbins et al. | 42/1 LP |
| 3,360,880 | 1/1968 | Finnegan | 42/1 LP |
| 4,048,741 | 9/1977 | Chiodo et al. | 42/1 LP |
| 4,092,794 | 6/1978 | Moren | 42/1 LP |

*Primary Examiner*—Charles T. Jordan
*Attorney, Agent, or Firm*—Paul J. Sutton

[57] ABSTRACT

Revolvers are used by a wide segment of the population and it is difficult to supervise the use of these firearms unless they are kept under lock and key in a cabinet. The present invention enables the owner of a revolver to disable operation of the cylinder of the revolver by inserting the safety locking unit of this invention. When inserted, the safety locking unit cannot be removed by unauthorized persons since removal requires a key. The presence of the safety locking unit does not affect the normal handling of the revolver such as holstering of its inherent safety features.

12 Claims, 6 Drawing Figures

FIG. 1
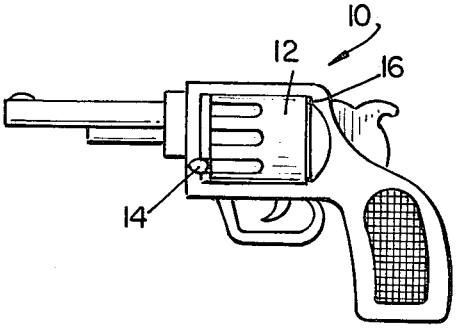
FIG. 2
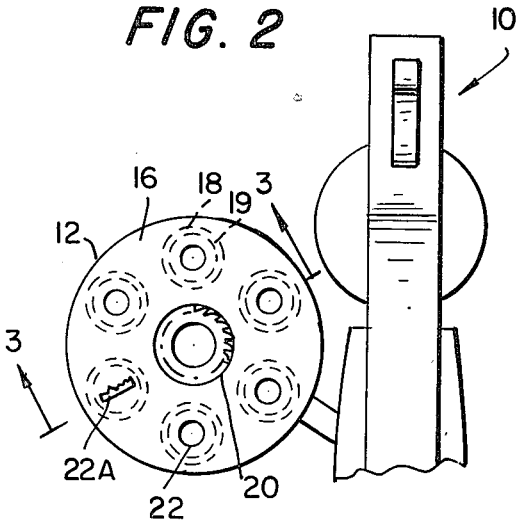
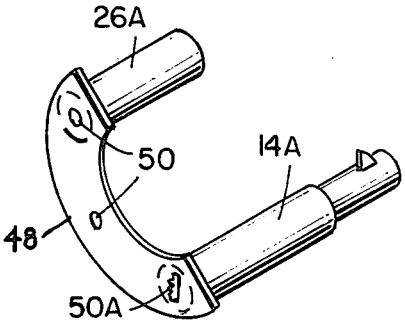
FIG. 4
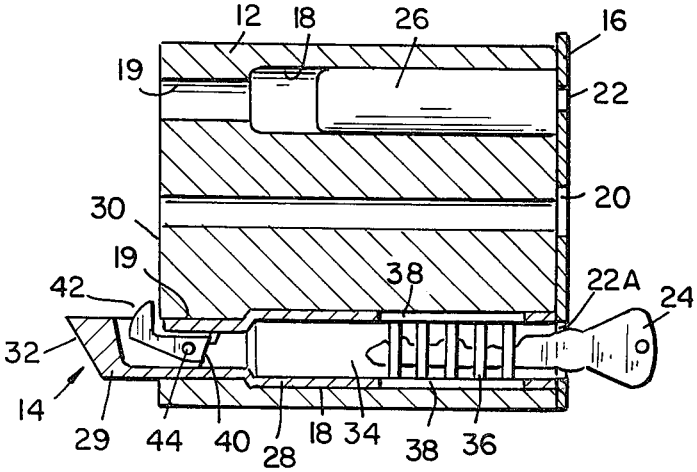
FIG. 3
FIG. 5
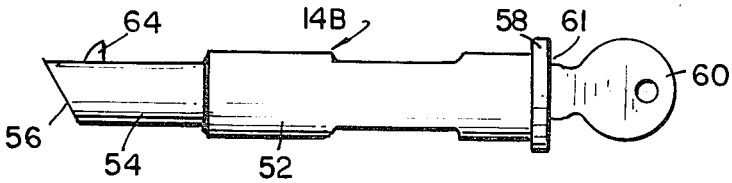
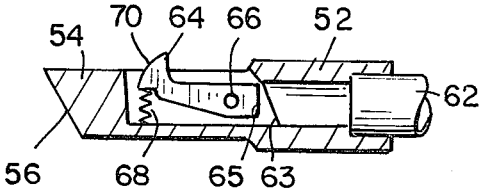
FIG. 6

REVOLVER SAFETY LOCK

BACKGROUND OF THE PRESENT INVENTION

1. Field of the Invention:

The present invention relates to firearms in general. In particular the present invention relates to firearms known specifically as revolvers which have rotating cylinders containing firing chambers.

2. Description of the Prior Art:

Let us now look at certain prior art patents which while not anticipatory of the present invention, disclose representative examples of previous or known efforts to solve some of the problems associated with the art.

U.S. Pat No. 2,664,658 to Bjorklund discloses a trigger lock used to disable the trigger of any revolver fitted with his lock. The locking device 10 is comprised of two plates 16 and 17 which clamp together. Plates 16 and 17 are fitted from opposite sides of the trigger guard 12 and immobilize the trigger 14. Plates 16 and 17 are held together by a lock 30 which requires the insertion of a key in order to separate the plates 16 and 17.

Bjorklund's trigger lock consists of two plates which are difficult to manipulate while holding the revolver. The two parts may become separated and the trigger lock is inoperative if one plate is lost. Further, the trigger lock may make the revolver difficult to holster and unholster.

U.S. Pat. No. 3,027,674 to Mahan discloses a casing which is inserted into a chamber of the revolver and locks the chamber to the barrel of the revolver. The casing 10 contains a spring loaded plunger 12 which can be manually recessed into casing 10. In use the cylinder 34 of revolver 28 is opened and casing 10 is inserted. The cylinder 34 is then closed and plunger 12 together with cylinder 34 are manipulated so that plunger 12 will jump into barrel 26. With the plunger 12 in barrel 26 the cylinder cannot be rotated.

The plunger can be readily manipulated by any rod or pencil placed into the barrel of the revolver. The "secret" of the invention is readily apparent to any one given some time. Further, the casing will not serve to lock jointed frame revolvers.

U.S. Pat. No. 3,352,047 to McDonnell discloses a locking device L which is clamped to the trigger guard G of a firearm. The locking device L is designed so it can be used in several positions to lock the trigger T of most firearms. McDonnell's locking device can also be used for firearms with two triggers.

McDonnell's locking device inhibits normal handling and holstering of the firearm. The locking device will mar the finish of the firearm it is attached to and the extending ridge of the locking screw can be grasped by long nose pliers making it easy to remove the locking device.

U.S. Pat. No. 3,368,297 to Lentz discloses a generally U shaped rod one end of which is inserted into the barrel of the disabled firearm. The safety rod 1 is U shaped and the gun barrel rod 2 is inserted into the barrel. The trigger guard extending rod 4 is locked to the trigger guard 9 by the lock 12.

Lentz's invention is cumbersome to carry around in the unlocked condition. In the locked condition the locking rod prevents the firearm from being holstered in the normal manner.

U.S. Pat. No. 3,392,471 to Foote discloses a set of plates which lock over the trigger guard and prevents access to the trigger housed within the trigger guard.

The trigger lock 10 is comprised of two portions each portion consisting of a plate 14 or 15 each having a resilient pad 16 attached. When trigger lock 10 is applied so as to clamp trigger guard 11 access to the trigger 13 is blocked.

The two portions of Foote's invention prevent the normal holstering of the firearm. The two portions of the trigger lock requires that each not be misplaced since one is inoperative without the other. Further, the plates of the trigger lock appear to be easily deformable aiding removal of the lock.

U.S. Pat. No. 3,462,869 to Wallace discloses a locking mechanism which is made part of the firearm by modifying the firearm. The lock cylinder housing 11 can be manipulated so as to trap or free the hammer 8 of the firearm 6. The locking is accomplished by means of a removeable key 24 which is inserted into lock tumbler 25.

Wallace's locking mechanism requires mechanical alteration of the firearm to which it is attached. To prevent the possibility of subsequent jamming of the firearm it must be disassembled and reassembled. The required mechanical operations make application of Wallaces locking mechanism costly to install.

To summarize the prior art, Bjorklund discloses a two part trigger lock which will become inoperative if one part is lost. Further, the lock may make it difficult to holster and unholster the revolver.

Mahan discloses a lock for revolvers which can be disabled by any slender device such as a pencil. Further the lock disclosed by Mahan will not lock jointed frame revolvers.

McDonnel discloses a locking device which will mar the finish of the firearm it is attached to and the locking device may be removed by an easily available long nose pliers.

Lentz discloses a locking device which is cumbersome to carry unattached and when attached to a firearm prevents the normal holstering of the firearm.

Foote discloses a trigger locking device similar to that of Bjorklund. Foote's device will also be inoperative if one part is lost and Foote's guard will prevent normal holstering and unholstering of the firearm.

Wallace's disclosure requires the mechanical modification of the firearm to which it is applied. His lock is uneconomical since it requires disassembly of the firearm and it can only be used with the firearm in which it is inserted.

SUMMARY OF THE INVENTION

The present invention is designed to provide a new and novel safety locking unit for revolvers which is of one piece construction and can be applied to the firearm without alteration thereof. The safety locking unit of the present invention fits into the chamber of the cylinder of the revolver. The insertion of the safety unit into the chamber will prevent the chamber from rotating and thereby effectively disable the firearm. The safety unit can be removed easily by using a key. Since the key and safety unit are compact they can be easily stored.

The primary object of the present invention is to provide a new and novel safety locking unit for use with revolvers to prevent unauthorized use of the firearm.

Another object of the invention is to provide a safety locking unit for revolvers that does not require alternation or disassembly of the firearm to which it is attached.

Still another object of the invention is to provide a safety locking unit for revolvers which will fit within the firearm so that the firearm can be normally handled and holstered.

Yet another object of the invention is to provide a safety locking unit which can be used with all types of revolvers.

Yet still another object of the invention is to provide a safety locking unit for revolvers consisting of only one piece which can be quickly and easily applied.

Another object of the invention is to provide a safety locking unit which does not materially affect the appearance of the firearm. Therefore it may be displayed without showing evidence of being unfireable.

A further object of the invention is to provide a means for temporarily disabling target type revolvers in order to comply with legal requirements.

The foregoing and other objects, features and advantages of the present invention will become apparent from the following description taken in connection with the accompanying drawings.

BRIEF DESCRIPTION OF THE DRAWINGS

FIG. 1 is a plan view of a revolver with the present invention attached;

FIG. 2 is a fragmentary rear end view of the revolver showing the cylinder open and a safety lock of the first type attached;

FIG. 3 is a section taken thru line 3—3 of FIG. 2;

FIG. 4 is a perspective view of a safety lock of the second type;

FIG. 5 is a plan view of a safety lock of the third type;

FIG. 6 is an alternate configuration for the safety lock.

DESCRIPTION OF THE EMBODIMENTS

FIG. 1 illustrates the appearance of a revolver with the safety lock, generally designated 10. A cylinder 12 is shown to which is affixed a first safety lock 14. The safety lock 14 is attached to a support ring 16 seen abutting the rear of the cylinder 12. As can be further seen a portion of the safety lock 14 protrudes from the chamber in the cylinder 12. The revolver 10 is then seen in FIG. 1 to have a safety lock 14 affixed yet to appear as if it is a conventional weapon.

FIG. 2 is a partial view from the rear of the revolver with safety lock 14. In this figure the cylinder 12 has been opened to show the rear of the cylinder 12. Placed over the end of cylinder 12 is the support ring 16 first ssen in FIG. 1. The support ring 16 can be seen to cover a set of cartridge chambers 18 which is part of the cylinder 12. Concentric with the set of cartridge chambers 18 is a set of bullet openings 19 which are formed in the front of the cylinder 12. The set of cartridge chambers 18 accept the cartridge casing and the set of bullet openings accept the bullet portion of each cartridge. The foregoing is more clearly illustrated in FIG. 3. A central opening 20 provides clearance for the cylinder 12 operating mechanism. The support ring 16 has a series of pin openings 22 which are made in the support ring 16. The series of pin openings 22 are made coaxial with each one of the set of chambers 18. Of the six openings 22, five are round holes in the support ring 16 while the sixth is a somewhat rectangular key opening 22A which will accept a key 24 (shown in FIG. 3). The purpose of the pin openings 22 and key opening 22A is to allow the firing pin (not shown) of the revolver 10 to be released without damage to the firing pin which may result if it struck something other than a cartridge.

FIG. 3 shows a section taken through line 3—3 of FIG. 2. In FIG. 3 the cylinder 12 can be seen, as can the set of cartridge chambers 18 and the set of bullet openings 19. The support ring 16 is shown abutting the rear of cylinder 12. Also seen are one of the series of pin openings 22 and the key opening 22A. In the upper portion of the cylinder 12 is seen a guide rod 26 which is slideably inserted into the upper chamber of cylinder 12. The guide rod 26 is welded, soldered or otherwise ridigly attached to the support ring 16. Further, the guide rod may fill all of the cartridge chamber, a portion of the cartridge chamber (as shown) or may enter the bullet opening.

The lower portion of cylinder 12 is seen to have the first safety lock 14 inserted into the cartridge chamber shown. A tubular member 28 is seen to occupy the entirety of the lower cartridge opening 18. A smaller diameter portion 29 enters the bullet opening 19 and projects beyond a cylinder front face 30. The further most projection of the portion 29 is a sloping end face 32. The slope of end face 32 is used to prevent the safety lock 14 from catching while the revolver 10 is being holstered. Sloping the end face 32 also makes it more difficult to forcibly remove the safety lock 14. End face 32 may further be coated with plastic material to prevent damage to any portions of the revolver 10 it may contact.

The tubular member 28 has rotatably mounted within itself a lock cylinder 34. Affixed to the lock cylinder 34 is a set of disc tumblers 36. The disc tumblers 36 are spring loaded by means not shown so as to engage a pair of slots 38 formed in the tubular member 28 as shown. With the key 24 withdrawn the disc tumblers 36 enter the pair of slots 38 and lock the lock cylinder 34 to the tubular member 28. Insertion of the key 24 into the key opening 22A allows the key 24 to cause the set of disc tumblers 36 to withdraw from the pair of slots 38 thereby allowing lock cylinder 34 to rotate with respect to the tubular member 28.

Rotation of the lock cylinder 34 causes a first cam surface 40 at the end of the lock cylinder 34 to allow a latch 42 to retract away from the cylinder front face 30 permitting withdrawal of the safety lock 14. The latch 42 is seen to be housed within the smaller diameter portion 29 and is affixed thereto by a pivot pin 44. Engagement of the abuting cam surface on the latch 42 with the first cam surface 40 will cause the latch 42 to move into or out of the smaller diameter portion 29 as the first cam surface 40 is rotated 180 degrees.

FIG. 4 illustrated a second safety lock embodiment having a partial support ring 48 which is slightly larger than a guide rod 26A and a safety lock 14A which is fastened to it. The guide rod 26A and the safety lock 14A are similar in purpose and function to the guide rod 26 and the safety lock 14 although they may vary in actual construction. Also shown in FIG. 4 is a pair of pin openings 50 and a second key opening 50A having the same purpose and function as the series of pin openings 22 and the first key opening 22A. The partial support ring 48 allows the guide rod 26A and the safety lock 14A to have an empty cartridge chamber between them. The partial support ring 48 may be made of any size thereby allowing the safety lock 14A and the guide rod 26A to be placed in adjacent cartridge chambers as one arrangement or in any other arrangement considered operable.

FIG. 5 illustrates a third safety lock 14B embodiment. Here is shown a second tubular member 52 having a second smaller diameter portion 54 and further having a second sloping end face 56. The aforementioned portions of the third safety lock 14B are similar in purpose and function to the corresponding portions of the first safety lock 14. What is new is the attachment of a collar 58 to the end of the second tubular member 52 proximate to a second key 60. The collar 58 has a third key opening 61 on its outside face. The third safety lock 14B employs a second latch 64 mechanism which is shown in FIG. 6 and will be described in conjunction with FIG. 6.

FIG. 6 shows a cross-section of a portion of the third safety lock 114B showing details of the novel latch mechanism. A second lock cylinder 62 is shown within the second tubular member 52. The second lock cylinder 62 is shown to have a third cam surface 63 which abuts a fourth cam surface 65 on one end of the second latch 64. The second latch 64 is pivotally mounted within the second smaller diameter portion 54 by means of a second pivot pin 66. The second latch 64 is kept in an extended position by a spring 68.

The second latch 64 may be depressed by a finger or similar tool, or, because of a rounded portion 70, may be forced inward when being inserted into the bullet opening portion of the cartridge chamber. The third cam surface 63 is shown in a position which will allow the second latch 64 to move inward. When second lock cylinder 62 is rotated 180 degrees after insertion of the second key 60 the third cam surface 63 is positioned so as to interfere with the movement of the fourth cam surface 65 which is located on one end of the second latch 64.

Operation of the embodiments will be better understood by the following description taken in conjunction with the aforedescribed drawings.

FIG. 2 shows the cylinder 12 of a revolver 10 in the open position. In order to insert the first safety lock 14 into the cylinder 12 the revolver 10 must be prepared by unloading the revolver 10 and placing the hammer in the down position. Before insertion of the safety lock 14 it must be verified that the hook portion of the latch 42 is in a retracted position. The retracted position is obtained by inserting the key 24 and rotating it 180 degrees.

FIG. 3 shows the details of the engagement between the safety lock 14 and the cylinder 12. The first safety lock 14 is first engaged by inserting the smaller diameter portion 29 into one of the cartridge chambers 18. As the tubular member 28 enters the cartridge chamber the guide rod 26 must be guided into a diametrically opposite cartridge chamber 18. When the safety lock 14 is fully engaged, as indicated by the support ring 16 being in abutment with the rear face of the cylinder 12, the key 24 is fully inserted into the key slot 22A and the key 24 rotated 180 degrees. Rotation of the key 24, 180 degrees causes the hook portion of the latch 42 to be extended so that withdrawal of safety lock 14 is prevented.

The safety lock 14 is particularly useful on the revolver 10 of the swing-out cylinder type and of the solid frame type and may be the only safety lock for use with the break open jointed frame revolver. The pin openings 22 are present in order to prevent damage to the firing pin should an attempt be made to fire the revolver 10. Further, the openings 22 allow the chambers 18 to be inspected to see if they are blocked. FIG. 1 shows the first safety lock 14 installed and the only evidence of its presence is the slight projection from the cylinder 12. The sloping end face 32 is designed so that its presence will not inhibit holstering and unholstering of the firearm. Some revolvers may require a slight modification of the smaller diameter portion 29 to ensure proper operation of the safety lock 14.

Additional features of the safety lock 14 are one, that if the support ring 16 is broken away the tubular member 28 which carries the locking mechanism cannot be removed since the shoulder formed between the tubular member 28 and the smaller diameter portion 29 prevents the safety lock 14 from falling or being pushed through the bullet openings 19. Secondly, the sloping end face 32 reduces the possibility of tampering.

FIG. 4 illustrates the second safety lock 14A having the partial support ring 48. The safety lock 14A is engaged with the cylinder 12 in a manner similar to that employed for safety lock 14. The primary difference between the safety lock 14 and the safety lock 14A is that the partial support ring 48 allows the placement of live cartridges in those chambers 18 not covered by the support ring 48. When the second safety lock 14A is in place the firearm can not be fired, as soon as the safety lock 14A is removed the firearm may be used immediately. This embodiment is only suitable for use with swing-out cylinder and solid frame type revolvers.

FIG. 5 illustrated the third safety lock 14B which is particularly suitable for revolvers having no room for the placement of the support ring 16. Revolvers of the aforementioned type have recesses which receive the rims of the live cartridges. Consequently the third safety lock 14B has the collar 58 which fits into the aforementioned recess. Although FIG. 6 shows the detail of the second latch 64 mechanism used with the safety lock 14B there is no reason why each of the latch mechanisms described may not be used for all or any embodiment or that other latch mechanism may not be devised.

Further, although a single latch is illustrated in the drawings other latching configurations may be used to accomplish the same result.

The second latch 64 in the locked position can be depressed by a finger or by the cylinder itself as it is inserted. FIG. 6 illustrates the second latch 64 in the unlocked position. By placing the key 60 into the third safety lock 14B and rotating the second lock cylinder 62 the third cam surface 63 will interfere with the heel of the second latch 64 thereby preventing the latch 64 from moving inwardly. Removal of the safety lock 14B requires the use of the key 60 as well as manipulation of the second latch 64 by means of a pencil. The pencil is used to move the second latch 64 inward so that it will clear the bullet opening 19. Some large frame revolvers may require two devices such as the third safety lock 14B for full security.

The embodiments of the present invention particularly disclosed and described here in are presented merely as examples of the invention; other embodiments, forms and modification of the invention coming within the proper scope and spirit of the appended claims will of course readily suggest themselves to those skilled in the art.

What is claimed is:

1. A safety lock device for use with a firearm having a rotatable cylinder, including a plurality of cylinder chambers each cylinder chamber including a cartridge chamber portion and a bullet opening portion, the cylinder having a front face having bullet opening apertures and a rear face having cartridge chamber apertures, a tubular member adapted for insertion into a cylinder chamber of said cylinder said tubular member including a first tubular portion disposable within said cartridge chamber portion and a second tubular portion disposable within said bullet opening portion, said first tubular portion including a front portion adapted to extend past said front face of said cylinder and having an opening coextensive with said first tubular portion, a latch housed within said front portion of said first tubular portion, said latch including a front locking portion and a rear portion pivotably mounted with said tubular member, said latch being rotatably movable between locked and unlocked positions, wherein in said locked position said locking portion extends through said opening into a position adjoining said front face of said cylinder and wherein in said unlocked position said locking portion is withdrawn away from said front face of said cylinder into said first tubular portion, locking means for moving said latch between said unlocked position and said locked position, and stop means associated with said tubular means at said rear face of said cylinder for limiting movement of said tubular member into said cylinder chamber towards said front face, whereby when said tubular member is inserted into said cylinder chamber, said latch is moved into the locking position upon activation of said locking means.

2. A safety lock device according to claim 1, wherein said locking means includes a biasing means positioned in said front portion of said first tubular portion for biasing said locking portion of said latch from said unlocked position to said locked position and a manually operated tool for pressing said locking portion of said latch into said first tubular portion through said opening.

3. A safety lock device according to claim 2, further including a locking cylinder positioned in said second tubular portion of said tubular member, said locking cylinder having a key opening at one end at said rear face of said rotatably cylinder and an opposed end adjoining said first tubular portion; a latch jam means at said rear portion of said latch and a locking cylinder jam means at said opposed end of said locking cylinder, said locking cylinder jam means being for jaming said latch into remaining in said locked position by being positioned into adjoining relationship with said latch jam means upon rotation of said locking cylinder with a key.

4. A safety lock device according to claim 3, wherein the diameter of said second tubular portion is greater than the diameter of said first tubular portion, said first and second tubular portions being concentric, said first and second tubular portions forming between them an annular shoulder that is adapted to abut the shoulder formed in the cylinder chamber between the cartridge chamber and the bullet opening.

5. A safety lock device according to claim 4, wherein said stop means further includes a flange attached to said tubular member adapted to be in abutting relationship with said rear face of said rotating cylinder.

6. A safety lock device according to claim 1, wherein said locking means includes a lock cylinder positioned in said second tubular portion of said tubular member, said lock cylinder having a key opening at one end and an opposed end adjoining said first tubular portion; a latch cam means at said rear portion of said latch and lock cylinder cam means at said opposed end of said lock cylinder, said lock cylinder cam means being for caming said latch cam means and moving said latch into said locked position upon rotation of said lock cylinder in one direction with a key and further being for uncamming said latch cam means and moving said latch into said unlocked position upon rotation of said lock cylinder in another direction with a key.

7. A safety lock device according to claim 6, wherein the diameter of said second tubular portion is greater than said first tubular portion, said first and second tubular portions being concentric, said first and second tubular portions forming an annular shoulder.

8. A safety lock device according to claim 1, wherein said stop means further includes a flange attached to said tubular member.

9. A safety lock device according to claim 5 or claim 8, wherein said flange portion comprises a partial support ring covering a portion of said rear face of said rotatable cylinder, said tubular member being attached to one end of said ring, and a guide rod attached to the other end of said ring, said guide rod being positioned in one of said plurality of cylinder chambers.

10. A safety lock device according to claim 5 or claim 8, wherein said flange portion comprises a full support ring covering all of said rear face of said rotatable cylinder, said tubular member being attached to one portion of said full ring, and a guide rod attached to another portion of said full ring, said guide rod being positioned in one of said plurality of cylinder chambers.

11. A safety lock device according to claim 9, wherein said partial support ring forms pin openings positioned coaxial with each of said cartridge chambers.

12. A safety lock device according to claim 10, wherein said full support ring forms pin openings positioned coaxial with each of said cartridge chambers.

* * * * *